US008180253B2

(12) United States Patent
Hayashi et al.

(10) Patent No.: US 8,180,253 B2
(45) Date of Patent: May 15, 2012

(54) IMAGE FORMING APPARATUS COLLECTING AND DISTRIBUTING UNTRANSFERRED DEVELOPER

(75) Inventors: Hideaki Hayashi, Toyokawa (JP); Kuniya Matsuura, Toyohashi (JP); Junji Kanda, Toyota (JP); Yasuaki Tomoda, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 1137 days.

(21) Appl. No.: 11/968,291

(22) Filed: Jan. 2, 2008

(65) Prior Publication Data

US 2008/0166162 A1 Jul. 10, 2008

(30) Foreign Application Priority Data

Jan. 4, 2007 (JP) ..... 2007-000085

(51) Int. Cl.
*G03G 15/08* (2006.01)
*G03G 21/00* (2006.01)

(52) U.S. Cl. ..... 399/120; 399/359

(58) Field of Classification Search ..... 399/120, 399/360, 119, 262, 263, 358, 359
See application file for complete search history.

(56) References Cited

U.S. PATENT DOCUMENTS

| | | | | |
|---|---|---|---|---|
| 6,339,689 | B1 * | 1/2002 | Sugiura | 399/120 |
| 6,625,414 | B2 | 9/2003 | Izumi | |
| 6,711,366 | B2 * | 3/2004 | Beaufort | 399/120 |
| 7,103,308 | B2 * | 9/2006 | Wakana | 399/358 |
| 7,127,207 | B2 | 10/2006 | Tsurusaki | |
| 2006/0002750 | A1 | 1/2006 | Ono | |

FOREIGN PATENT DOCUMENTS

| | | | |
|---|---|---|---|
| JP | 61-153683 | A | 7/1986 |
| JP | 02-062460 | U | 5/1990 |
| JP | 03-075768 | | 3/1991 |
| JP | 11-153901 | A | 6/1999 |
| JP | 2003-228214 | A | 8/2003 |
| JP | 2005-049689 | | 2/2005 |
| JP | 2005-266530 | | 9/2005 |
| JP | 2006-018050 | A | 1/2006 |

OTHER PUBLICATIONS

Office Action in JP 2007-000085 dated Dec. 16, 2008.
An English Translation of the Office Action in JP 2007-000085 dated Dec. 16, 2008.

* cited by examiner

*Primary Examiner* — Sandra Brase
(74) *Attorney, Agent, or Firm* — Buchanan Ingersoll & Rooney PC

(57) ABSTRACT

An electrophotographic image forming apparatus has an electrostatic latent image bearing members, developing devices each including developer and capable of developing corresponding electrostatic latent images on the electrostatic latent image bearing members into visualized developer images, a transfer device capable of transferring the developer images to a sheet, first collecting devices each capable of collecting untransferred developer from the electrostatic latent image bearing members, developer supply devices each capable of supplying the developer to the corresponding developing devices, accommodating sections each combined with the corresponding developer supply devices and capable of accommodating the untransferred developer, a collecting and distributing device capable of collecting the untransferred developer collected by the first collecting devices and distributing the collected untransferred developer to the accommodating sections, and a housing capable of retaining the developer supply devices so that each of the developer supply devices is releasable together with the corresponding accommodating section from the housing.

7 Claims, 3 Drawing Sheets

IMAGE FORMING APPARATUS COLLECTING AND DISTRIBUTING UNTRANSFERRED DEVELOPER

FIELD OF THE INVENTION

The present invention relates to an image forming apparatus using a powder developer, such as a copying machine, a printer and a facsimile and a multi-function periphery having those functions in combination.

BACKGROUND OF THE INVENTION

Conventionally, an electrophotographic image forming apparatus such as a copy machine and a printer includes a mechanism for collecting untransferred toner particles from a photosensitive member. Also, a full color image forming apparatus including an intermediate transfer member on which toner images are transferred from the photosensitive members and then onto a sheet includes a mechanism for collecting untransferred toner particles from the intermediate member.

The collecting mechanism may be incorporated in the image forming apparatus in various ways. For example, Document 1 (JP 61-153683 A) discloses an image forming apparatus in which a container for the collected toner particles is combined with another container for receiving a supply toner to reduce the size of and increase the operability of the apparatus. Document 2 (JP 11-153901 A) discloses another image forming apparatus in which a container is partitioned by a flexible member to define chambers for the supply toner and the collected toner, respectively. Document 3 (JP 2006-18050A) discloses another image forming apparatus in which toner particles collected from the photosensitive member and also the intermediate transfer member are transported into the black toner developing device where they are reused for the image formation. Document 4 (JP 2003-228214 A) discloses another image forming apparatus including a first collecting mechanism for collecting respective untransferred color toner particles into the corresponding developing devices and a second collecting mechanism for collecting all the untransferred color toner particles into the black color developing device.

As described above, each collecting mechanism of the conventional image forming apparatuses is designed to transport the untransferred toner particles into a single, specific container. This results in that the container becomes full of the collected toner particles within a short period of time in circumstances where a considerably amount of toner is consumed, which requires to exchange the containers so frequently.

SUMMARY OF THE INVENTION

Accordingly, the present invention provides an electrophotographic image forming apparatus using a powder developer, includes electrostatic latent image bearing members;

developing device each including developers and capable of developing corresponding electrostatinc latent images on the electrostatic latent image bearing members into visualized developer images;

transfer device capable of transferring the developer images to a sheet;

a first collecting device each capable of collecting untransferred developer from the electrostatic latent image bearing members;

developer supply devices each capable of supplying the developers to the corresponding developing devices;

accommodating sections each combined with the corresponding developer supply devices and capable of accommodating the untransferred developer;

a collecting and distributing device capable of collecting the untransferred developers collected by the first collecting devices and distributing the collected untransferred developers to the accommodating sections; and a housing capable of retaining the developer supply devices so that each of the developer supply devices is releasable together with the corresponding accommodating section from the housing.

In accordance with the image forming apparatus, the untransferred developer collected into the collecting devices is distributed and supplied to the accommodating sections. Therefore, when exchanging the developer supply devices, the untransferred developer is also discarded, which in turn eliminates a discarding operation only the untransferred developer.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
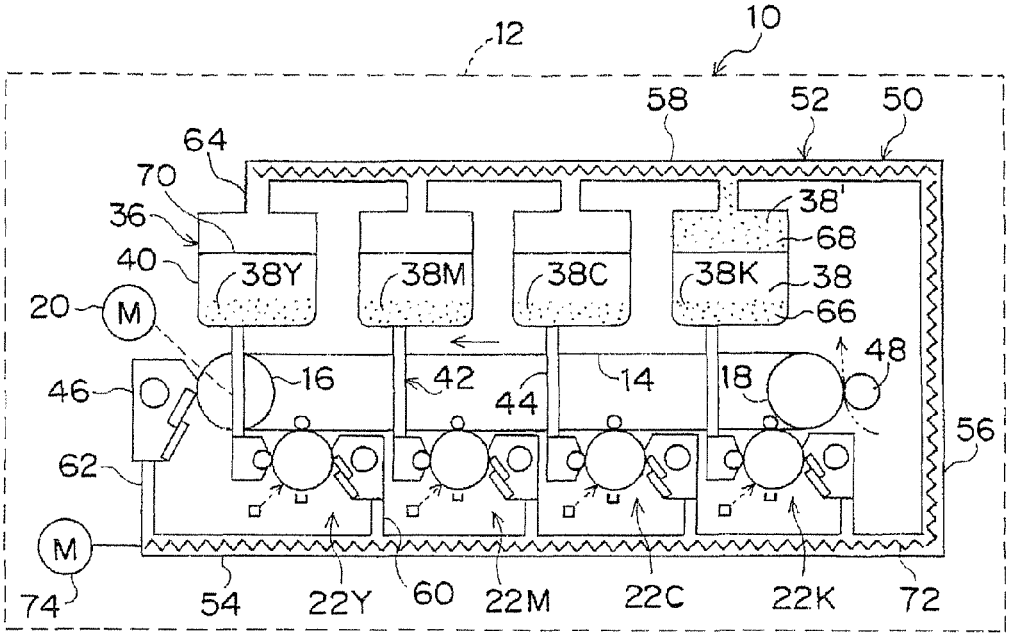
FIG. 1 is a cross sectional view showing a general structure of an embodiment of an image forming apparatus in accordance with the present invention.

The following description of the preferred embodiments are merely exemplary in nature and are in no way intended to limit the invention, its application, or uses.

Referring to the drawings, several preferred embodiments of the image forming apparatus according to the present invention will be described below.

FIG. 1 shows an embodiment of the image forming apparatus generally indicated at 10 in accordance with the present invention. The image forming apparatus 10, which is a full-color image forming apparatus, has a housing 12 accommodating and supporting various structures to be described below. A transfer member is disposed in substantially the central portion of the housing 12. In this embodiment, an intermediate transfer belt 14, i.e., first transfer member, is used for the transfer member. The intermediate transfer belt 14 is made of an endless belt and supported by rollers 16 and 18 disposed on left and right sides on the drawing. One of the rollers 16 and 18 is connected to a motor 20 so that the intermediate transfer belt travels in the counterclockwise direction by the driving of the motor 20.

Figure 2:
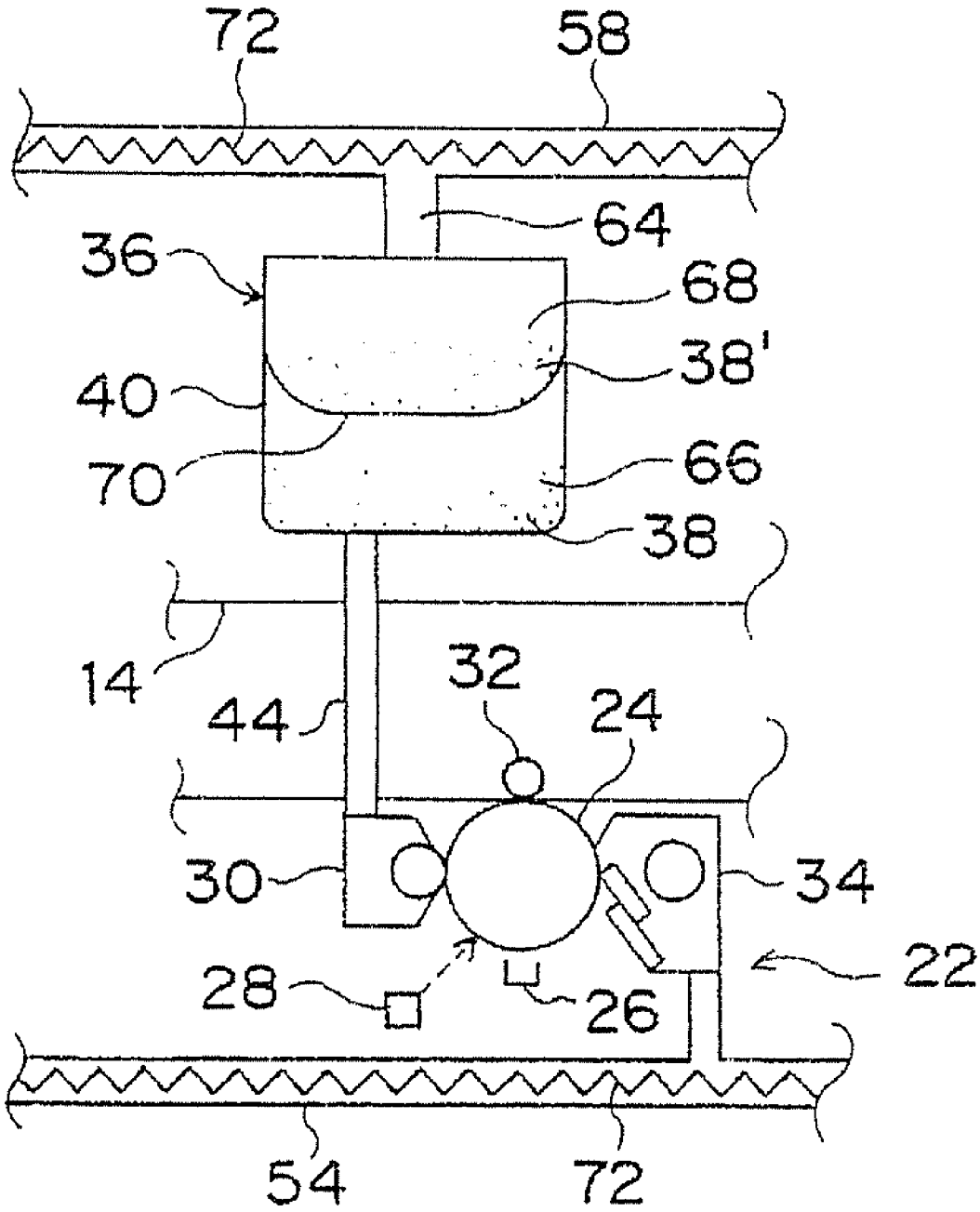
FIG. 2 is a cross sectional view showing a second embodiment of the image forming apparatus according to the present invention.

Four imaging units 22 (22Y, 22M, 22C, and 22K) are disposed adjacent the lower belt portion of the intermediate transfer belt 14 running from the left roller 16 toward the right roller 18. As shown in FIG. 2, each imaging unit 22 has a plurality of components required for forming visualized images according to the electrophotographic imaging forming process.

More specifically, each imaging unit 22 has an electrostatic latent image bearing member in the form of photosensitive member 24. In this embodiment, a cylindrical photosensitive member or drum 24 is used. Disposed around the drum 24 several units including a charging device 26, an optical device 28, a developing device 30, a transfer device 32 and a cleaning device (first collecting device) 34.

The developing device 30 accommodates a powder developer in the form of particles. More specifically, developing devices 30Y, 30M, 30C, and 30K of the four imaging units 22 (22Y, 22M, 22C, and 22K) accommodate powder developers or toners of yellow, magenta, cyan and black colors, respectively. Referring back to FIG. 1, four developer supply units 36 (36Y, 36M, 36C, and 36K) are releasably retained in the housing 12 above the intermediate transfer belt 14, for example, to supply respective developers to the developing devices 30Y, 30M, 30C, and 30K. Respective developer supply units 36 have housings or containers 40 (40Y, 40M, 40C and 40K) for accommodating developers 38 (38Y, 38M, 38C and 38K). The containers 40 are connected to the corresponding developing devices 30 through developer supplying passages 44 of a developer supply mechanism 42 so that developers 38 are supplied from the containers 40 to the corresponding developing devices 30 through the corresponding supplying passages 44, respectively.

A cleaning device (second collecting unit) 46 is disposed outside and adjacent a portion of the intermediate transfer belt supported by the left roller 16. A transfer device (second transfer member) 48 is disposed outside and adjacent a portion of the intermediate transfer belt supported by the right roller 18.

The full color image forming operation conducted by the image forming apparatus so constructed will be described briefly. In this operation, the photosensitive member 24 of each imaging unit 22 is rotated in the clockwise direction. An outer circumferential face of the photosensitive member 24 thus rotated is charged to a predetermined electric potential by the charging device 26 and then exposed to light to form an electrostatic latent image thereon. The electrostatic latent image is developed by the toner particles of the corresponding developing device 30 into a visual toner powder image or developer image. The visualized developer image is transferred onto an outer circumferential face of the intermediate transfer belt 14 running in the counterclockwise direction with an aid of the transfer device 32. The developer images transferred on the intermediate transfer belt 14 from respective imaging units 22 are superimposed one after another on the intermediate transfer belt 14 to form a full-color developer image which in turn is transferred, where the transfer device 48 opposes the belt 14, onto a sheet such as a paper being transported along a long and short dotted line. The full-color developer image on the sheet is fixed to the sheet by a heater-fixing device (not shown).

In this image forming operation, not all the toner particles on the photosensitive member 24 are transferred onto the intermediate transfer belt 14 and the untransferred toner particles remaining on the photosensitive member 24 are collected by the cleaning device 34. Likewise, not all the toner particles on the intermediate transfer belt 14 are transferred onto the sheet and the untransferred toner particle remaining on the intermediate belt 14 are collected by the cleaning device 46. The toner particles collected in the cleaning devices 34 and 46 are fed into a collecting and distributing unit generally indicated at 50.

The collecting and distributing unit 50 has a transport mechanism generally indicated at 52. For example, in this embodiment the transport mechanism 52 has a plurality of transport passages connected in line, i.e., a first transport passage 54 extending substantially in a horizontal direction below the four imaging units 22, a second transport passage 56 extending substantially perpendicularly upward from the right end of the first transport passage 54, and a third transport passage 58 extending substantially in the horizontal direction above the four developer supplying units 36 from an upper end of the second transport passage 56. The first transport passage 54 is connected to respective cleaning devices 34 through connecting sub-passages or first connecting portions 60 (60Y, 60M, 60C and 60K) so that the collected toner particles in respective cleaning devices 34 are dropped and supplied into the associated first transport passage 54 through the connecting passages 60. The first transport passage 54 is also connected to the cleaning device 46 through a connecting sub-passage or first connecting portion 62 so that the collected toner particles in the cleaning device 46 are dropped and supplied into the first transport passage 54 through the connecting passage 62. The third transport passage 58 is connected to respective containers 40 through distributing and connecting sub-passages for second connecting passages) 64 (64Y, 64M, 64C and 64K) so that the collected toner particles are dropped and supplied into the containers 40 from the third transport passage 58. To prevent the collected toner particles from being mixed into the unused developer 38, each of the containers 40 is divided and separated by a partition wall 70 into two chambers; lower chamber 66 (66Y, 66M, 66C, and 66K) for storing the unused new developer 38 and upper chamber (untransferred developer accommodating section) 68 (68Y, 68M, 68C, and 68K) for storing the collected toner particles. Although the interior of each container 40 is divided into upper and lower chambers, it may be divided into left and right chambers.

In order to transport the toner particles collected by the cleaning devices 34 and 46 to the chambers 68, one or more transport means such as helical coil or coils 72 or screws are disposed inside the transport passages 54, 56, and 58 of the transport mechanism 52. The coil or coils 72 are drivingly connected to a motor 74 so that, by the driving of the motor 74, the coils 72 rotate substantially about longitudinal axes thereof to transport the toner particles along the first transport passage 54 through the second transport passage 56 into the third transport passage 58. Although the first transport passage 54 is disposed below the cleaning devices 34 and 46 so that the toner particles are dropped from the cleaning devices 34 and 46 into the first transport passage 54 and the third transport passage 58 is disposed above the chamber 68 so that the toner particles are dropped from the third transport passage 58 into the containers 68 in the previous embodiment, coil(s) or screw(s) may be disposed in each of the connecting passages 60 and 62 and drivingly connected to the motor 74 or another motor so that, by the driving of the motor, the toner particles may be conveyed by the coil(s) or screw(s) from the cleaning device 34 and/or 46 to the first transport passage 54, or from the third transport passage 58 to the housing unit 68.

According to the collecting and distributing unit 50, the untransferred toner particles collected by respective cleaning devices 34 and 46 are transported into the first transport passage 54 through the corresponding connecting passages 60 and 62. Further, the toner particles are transported through the second transport passage 56 into the third transport passage 58 by rotations of the coil 72 driven by the motor 74. The toner particles in the third transport passage 58 arrives first at the entrance of the connecting passage 64 (64K) disposed on the most upstream side of the transport direction in the passage 58 where they are supplied through the connecting passage 64 (64K) into the chamber 68 (68K) of the container 40 (40K) and stored therein. A volume of the chamber 68 for storing the untransferred toner particles is limited. Then, when the chamber 68 (68K) is filled with the toner particles 38', the subsequent toner particles being transported in the passage 58 pass the entrance of the connecting passage 64 (64K) without entering into the passage 64 (64K) and then advance toward the second entrance of the connecting passage 64 (64C) where they are dropped through the passage 64 (64C) into the chamber 68 (68C) of the container 40 (40C) located on the downstream side of and closest to the container 40 (40K). In the same manner, when all the chambers on the upstream side in the transporting direction are filled with the untransferred toner particles 38', then the toner particles being transported in the passage 58 are distributed into the subsequent chamber on the downstream side.

Typically, similar to the single color image forming apparatus, the full color image forming apparatus consumes the greater amount of toner than other color toners, so that the container 40 (40K) of the black toner is most frequently exchanged with new one. Therefore, in this embodiment the container 40 (40K) for black toner is disposed on the most upstream side with respect to the untransferred toner transporting direction along the passage 58. Contrary to this, in an environment where full-color images are frequently formed by the image forming apparatus 10, positions of the containers 40 may be changed in accordance with the consumption amount of the toners. For example, where the cyan toner is most consumed and the yellow toner is least consumed, for example, the cyan, magenta and yellow toner containers 40 (40C, 40M, 40Y) are disposed so that the cyan toner container 40 (40C) takes the most upstream position, the yellow toner container 40 (40Y) takes the most downstream position, and the magenta toner container 40 (40M) takes the middle position, with respect to the transporting direction along the passage 58.

The present invention is not limited to the previous embodiment and it may include various modifications.

For example, as seen in FIG. 2 the partition 70 of each container 40 may be made of a flexible sheet or film or expandable sheet or film made of rubber, for example. In this instance, the volume of the chamber 68 increases with the consumption of the new toner particles in the other chamber 66. This allows the limited volume of the container is efficiently used.

Figure 3:
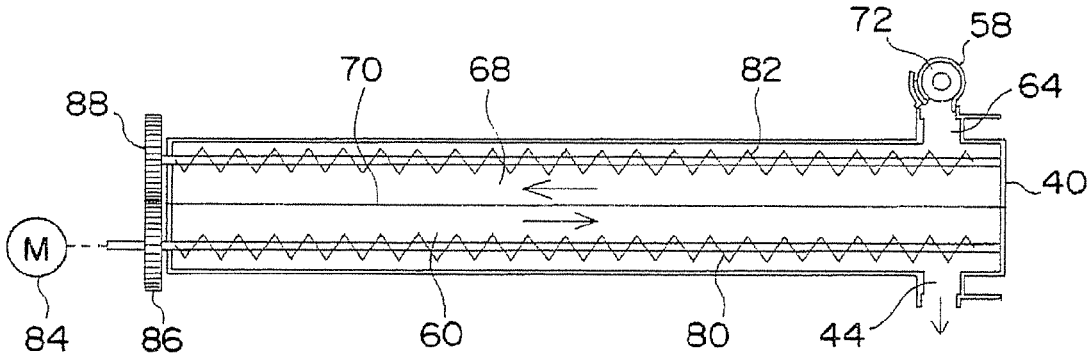
FIG. 3 is a cross sectional view showing a third embodiment of the image forming apparatus according to the present invention.

FIG. 3 shows another embodiment of the container 40. In this embodiment, toner transporting members in the form of screws 80 and 82 or coils are disposed within the chambers in the form of chambers 66 and 68, respectively. The screw 80 or 82 is connected to a motor 84. Also, the screws 80 and 82 securely supports gears 86 and 88 meshed with each other. According to this embodiment, the untransferred toner particles fed into the passage 68 are transported and forced toward the end of the chamber, away from the lower chamber 64, and the new toner particles in the passage 66 are transported toward the entrance of the supply passage 44. This prevents the passage 64 from being clogged with the untransferred toner particles 38' and also the limited volume of the container 40 is efficiently used.

Figure 4:
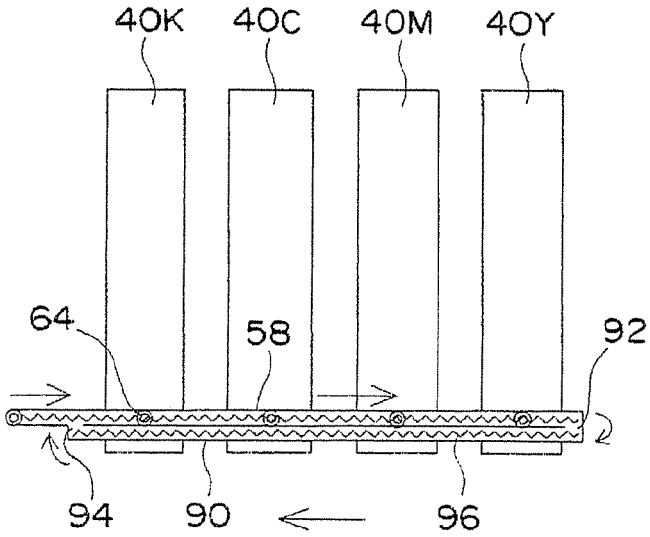
FIG. 4 is a diagram showing a fourth embodiment of the image forming apparatus according to the present invention.

FIG. 4 shows a further embodiment in which the transport mechanism 52 has a fourth transport passage 90. The passage 90 is disposed parallel to or substantially parallel to the third transport passage 58. The passages 58 and 90 are communicated with each other through paths 92 and 94 in the form of openings provided on opposite ends of the passage 90. A coil 96 is disposed in the passage 90 and drivingly connected to the motor 74. According to this embodiment, the untransferred toner particles 38' is transported within the passage 58 and then into the passage 90 through the path 92. The untransferred toner particles 38' in the passage 90 is transported in the opposite direction to reach the path 94 through which they are returned into the passage 58 so that the toner particles are circulated through the passages 58 and 90 through the connecting paths 92 and 94. With this arrangement, the untransferred toner particles are fed into respective containers 40 without fail.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electrophotographic image forming apparatus using a powder developer, comprising:

electrostatic latent image bearing members;

developing devices each including developer and capable of developing corresponding electrostatic latent images on the electrostatic latent image bearing members into visualized developer images;

a transfer device capable of transferring the developer images to a sheet;

first collecting devices each capable of collecting untransferred developer from the electrostatic latent image bearing members;

developer supply devices each capable of supplying the developer to the corresponding developing devices;

accommodating sections each combined with the corresponding developer supply devices and capable of accommodating the untransferred developer;

a collecting and distributing device capable of collecting the untransferred developer collected by the first collecting devices and distributing the collected untransferred developer to the accommodating sections; and a housing capable of retaining the developer supply devices so that each of the developer supply devices is releasable together with the associated accommodating section from the housing; wherein each of the developer supply devices has a first passage for transporting the developer to the corresponding developing device, and a first developer transport member disposed in the first passage, each of the accommodating sections has a second passage for accommodating the untransferred developer from the collecting and distributing device, and a second developer transport member disposed in the second passage, and the first and second developer transport members are coupled to a driving mechanism, the driving mechanism being adapted to drive the first and second developer transport members so that the first developer transport member transports the developer from the developer supply device to the developing device and the second developer transport member transports the developer away from the collecting and distributing device toward the developing device.

2. The image forming apparatus according to claim 1, wherein the transfer device has a first transfer member on which each of the developer images formed on the electrostatic latent image bearing members is transferred.

3. The image forming apparatus according to claim 2, wherein the transfer device has a second transfer member which transfers the developer image from the first transfer member onto the sheet.

4. The image forming apparatus according to claim 3, wherein the first transfer member is made of an annular belt, the image forming apparatus further comprises a second collecting device capable of collecting untransferred developer from the annular belt, and the collecting and distributing device collects the untransferred developer collected by the second collecting device.

5. The image forming apparatus according claim 1, wherein the collecting and distributing device includes a major passage through which the untransferred developer is transported;

first connecting portions each connecting the first collecting devices to the major passage so that the untransferred developer collected in the first collecting devices are supplied to the major passage through the first connecting portions;

second connecting portions each connecting the accommodating sections to the major passage and successively branched from the major passage so that the untransferred developer in the major passage is supplied to accommodating sections through the second connecting portions; and a transport member capable of transporting the untransferred developer in the major passage from the first connecting portions toward the second connecting portions.

6. The image forming apparatus according to claim 5, wherein the major passage has a first transport passage portion which successively passes through the second connecting portion, a second transport passage portion having a first end and a second end, the first end being connected to the first transport passage through a first path provided on a downstream side of the first connecting portions with respect to a transporting direction of the transport member and the second end being connected to the first transport passage through a second path provided on an upstream side of the first connecting portions with respect to the transporting direction; and a circulating transport mechanism capable of circulating the untransferred developer through the first transport passage, the first path, the second transport passage, and the second path.

7. The image forming apparatus according to claim 1, wherein the first developer transport member comprises at least one of a screw and a coil.

* * * * *